US008477470B2

(12) United States Patent
Kurosu et al.

(10) Patent No.: US 8,477,470 B2
(45) Date of Patent: Jul. 2, 2013

(54) ELECTRIC CHARGE ELIMINATING DEVICE AND IMAGE FORMING APPARATUS EQUIPPED WITH THE SAME

(75) Inventors: Shigetaka Kurosu, Tokyo (JP); Hiroshi Morimoto, Tokyo (JP); Nobuyasa Tamura, Aichi (JP); Yusuke Nishisaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 499 days.

(21) Appl. No.: 12/907,448

(22) Filed: Oct. 19, 2010

(65) Prior Publication Data

US 2011/0096453 A1 Apr. 28, 2011

(30) Foreign Application Priority Data

Oct. 28, 2009 (JP) ..... 2009-247573

(51) Int. Cl.
*H01T 23/00* (2006.01)

(52) U.S. Cl.
USPC ..... 361/212

(58) Field of Classification Search
USPC ..... 361/212
See application file for complete search history.

(56) References Cited

U.S. PATENT DOCUMENTS 7,970,318 B2 * 6/2011 Iwamatsu et al. ..... 399/168
8,369,747 B2 * 2/2013 Ueji et al. ..... 399/172
2007/0258737 A1 11/2007 Ogiyama et al.

FOREIGN PATENT DOCUMENTS

JP 2005-181863 7/2005

* cited by examiner

*Primary Examiner* — Stephen W Jackson
(74) *Attorney, Agent, or Firm* — Lucas & Mercanti, LLP

(57) ABSTRACT

An electric charge eliminating device for eliminating electric charge on an image carrying member or on a recording medium carrying member which is incorporated in an image forming apparatus, comprises a needlelike electrode having a plurality of protruding sections which form a plurality of discontinuous discharge points; an insulating holder for holding the needlelike electrode; a discharging power source for applying an electric voltage to the needlelike electrode; and a conductive shielding member arranged between the needlelike electrode and the image carrying member or the recording medium carrying member.

28 Claims, 9 Drawing Sheets

ELECTRIC CHARGE ELIMINATING DEVICE AND IMAGE FORMING APPARATUS EQUIPPED WITH THE SAME

This application is based on Japanese Patent Application No. 2009-247573 filed on Oct. 28, 2009, in Japanese Patent Office, the entire content of which is hereby incorporated by reference.

BACKGROUND OF THE INVENTION

The present invention relates to an electric charge eliminating device which eliminates electric charge on an image carrier used for an image forming apparatus of an electro-photographic system, or on a recording medium carrier, and relates to an image forming apparatus equipped with the electric charge eliminating device.

BACKGROUND ART

Conventionally, as an electric charge eliminating device which eliminates electric charge on an image carrier used for an image forming apparatus of an electro-photographic system, or on a recording medium carrier, usually used is a type which provides a high voltage to a wire electrode. In addition, another type that employs a needlelike (sawtooth like) electrode is also used in order to reduce ozone evolution and to save space.

However, in the type employing a needlelike electrode, there is a difference in electric-field strength between an electric field on a tip portion being a discharge point of a needlelike electrode and an electric field on a middle point to the adjoining tip portion, whereby discharge unevenness tends to take place. Further, in many cases of electric charge eliminating devices employing needlelike electrodes, in order to prevent the contact to a sharp tip portion, a rib-shaped partition wall made of insulating materials such as resin is used for the tip portion of a needlelike electrode. With this partition wall, discharge unevenness tends to take place more easily. If the whole electric field is strengthened too much in order to prevent poor electric charge elimination due to discharge unevenness, discharge at the tip portion of a needlelike electrode becomes strong too much, and the strong discharge causes discharge deterioration on the surface of an image carrier or a recording medium carrier for which electric charge elimination is conducted. As a result, there is a problem that poor cleaning and inferior transfer tend to occur easily.

Specifically, in an electric charge eliminating device having a structure that employs an intermediate transfer belt or a transfer belt made of resin as an image carrier or a recording medium carrier, there may be a case where polymer chains of resin materials are broken due to discharge unevenness such that whitened streaks-like flaws are caused on the surface. Further, in the case where a roller having a conductive resin coat layer is used as a roller around which an intermediate transfer belt or a transfer belt is wound, there is a problem that the resin coat layer is peeled off due to discharge unevenness of a needlelike electrode and the peeled-off resin coat layer adheres on the reverse surface of the belt. This peeling-off of the resin coat layer of the roller deteriorates the conductivity of a roller and the performance of a belt, and becomes a factor to worsen more the discharge deterioration of the intermediate transfer belt or the transfer belt In order to prevent such discharge unevenness, disclosed is a technique in which an insulating member is provided between an image carrier or a recording medium carrier and a needlelike electrode such that air clearance is created so as to prevent the discharge deterioration of the image carrier or the recording medium carrier (for example, refer to Japanese Unexamined Patent Publication No. 2005-181863, Official report).

However, if an tip member of a needlelike electrode is surrounded with an insulating member, the electric charge eliminating capacity becomes lower due to the lowering of the discharge effect. As a result, caused are separate fault of thin paper sheets, image defects accompanying toner scattering due to separation discharge at the time of the separating of recording medium. Further, in order to prevent discharge unevenness, if the distance between the tip portion of an electrode and an image carrier or a recording medium carrier is made longer, it is required to use a high voltage power source with a further more large capacity. As a result, caused is a new problem in terms of power consumption and space saving.

SUMMARY OF THE INVENTION

An object of the present invention is to solve the above problems and to provide an electric charge eliminating device which eliminates properly electric charges on an image carrier or a recording medium carrier without increasing the capacity and size of a power source and does not cause poor cleaning nor image defects, and to provide an image forming apparatus equipped with the electric charge eliminating device.

The abovementioned object is attained by the structure that reflects an aspect of the present invention.

An electric charge eliminating device for eliminating electric charge on an image carrying member or on a recording medium carrying member which is incorporated in an image forming apparatus, comprises:

- a needlelike electrode having a plurality of protruding sections which form a plurality of discharge points;
- an insulating holder for holding the needlelike electrode;
- a discharging power source for applying an electric voltage to the needlelike electrode; and
- a conductive shielding member arranged between the needlelike electrode and the image carrying member or the recording medium carrying member.

DETAILED DESCRIPTION OF THE PREFERRED EMBODIMENT

Hereafter, an embodiment of the present invention will be explained with reference to drawings. However, the present invention is not restricted to such an embodiment.

Figure 1:
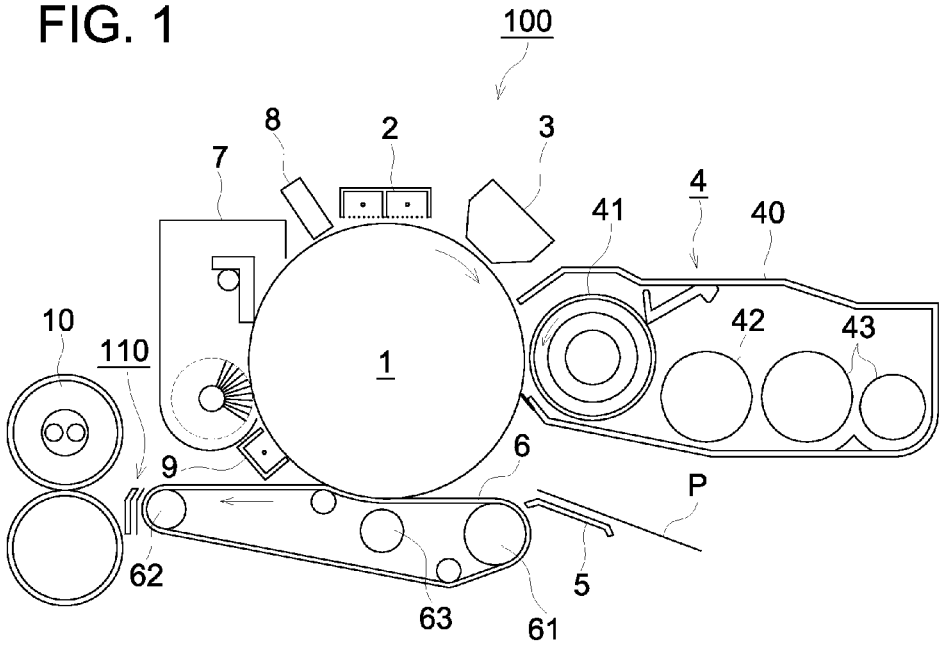
FIG. 1 is a principal part cross sectional view about an embodiment of an image forming apparatus equipped with an electric charge eliminating device 110 relating to the present invention and a transfer belt 6 as a recording medium carrier being an electric charge elimination object.

FIG. 1 is a principal part cross sectional view about an embodiment of an image forming apparatus equipped with an electric charge eliminating device 110 relating to the present invention and a transfer belt 6 as a recording medium carrier of an electric charge elimination object. In this drawing, an embodiment of a monochrome image forming apparatus 100 as an image forming apparatus will be explained.

In FIG. 1, numeral 1 is a photoreceptor drum as an image forming member, and the image forming apparatus 100 comprises, along the rotation direction of this photoreceptor drum 1, an electrification charger 2; an image write-in device 3 with a LED light source; a developing device 4 with a two component system; and a recoding sheet guide to lead a recording sheet P as a recording medium to a transfer region. Further, the image forming apparatus 100 comprises a transfer belt as an image carrier to transfer a toner image formed on the photoreceptor drum 1 to a recording sheet P; a cleaning device 7 to clean the photoreceptor drum 1 with brush and blade; a erasing device 8 to erase electric charge by irradiating a erasing light beam on the photoreceptor 1. Furthermore, between the transfer belt 6 and the cleaning device 7, a preliminary cleaning charger 9 is provided, and at the downstream side of the transfer belt 6, a fixing device 10 is provided so as to fix a toner image on a recording sheet P.

The developing device 4 has a developing sleeve 41 in an opening section of a housing 40, and at the backward of the developing sleeve 41 (in the right direction in the drawing), a developer conveyance member 42 to convey a developer (toner and carrier) to the developing sleeve 41 and an agitating member 43 to agitate toner and carrier are arranged.

The transfer belt 6 is stretched over between two supporting rollers 61 and 62, and is brought in pressure contact with a photoreceptor drum 1 by a backup roller 63 provided between the support rollers 61 and 62 inside the transfer belt 6. The transfer belt 6 is structured with two layers of a semiconductive belt base material and an insulating resin layer which is provided as a surface layer and has a volume resistivity more of $1\times10^7$ Ωcm or more, and the insulating resin layer being a surface layer is formed by coating or pasting. As the belt base material, for example, rubber base materials, such as chloroprene, may be employed, and as the insulating layer, a tetrafluoroethylene perfluoroalkyl vinyl ether copolymer resin (PFA) and the like may be employed.

Although the transfer belt 6 is made in the two layer structure in this embodiment, it also may be a resin-made belt composed of a single layer of only a belt base material.

An electric charge eliminating device 110 relating to the present invention is arranged opposite to a supporting roller 62 which is one of two supporting rollers 61 and 62 around which the transfer belt 6 is wound, and the electric charge eliminating device 110 eliminates a residual electric potential on the transfer belt 6 after the transferring of a toner image.

The backup roller 63 is connected to a constant current power source 64 in which an applying timing and an amount of current are controlled by a control section 11.

A pre cleaning charger 9 is a corotron type charger, and its electrode is connected to a constant current power source 90 in which an applying timing and an amount of current are controlled by the control section 11. In addition to the applying of current to the transfer belt 6 and the pre cleaning charger 9, the control section 11 controls respective process sections so as to perform an image formation.

Figure 2:
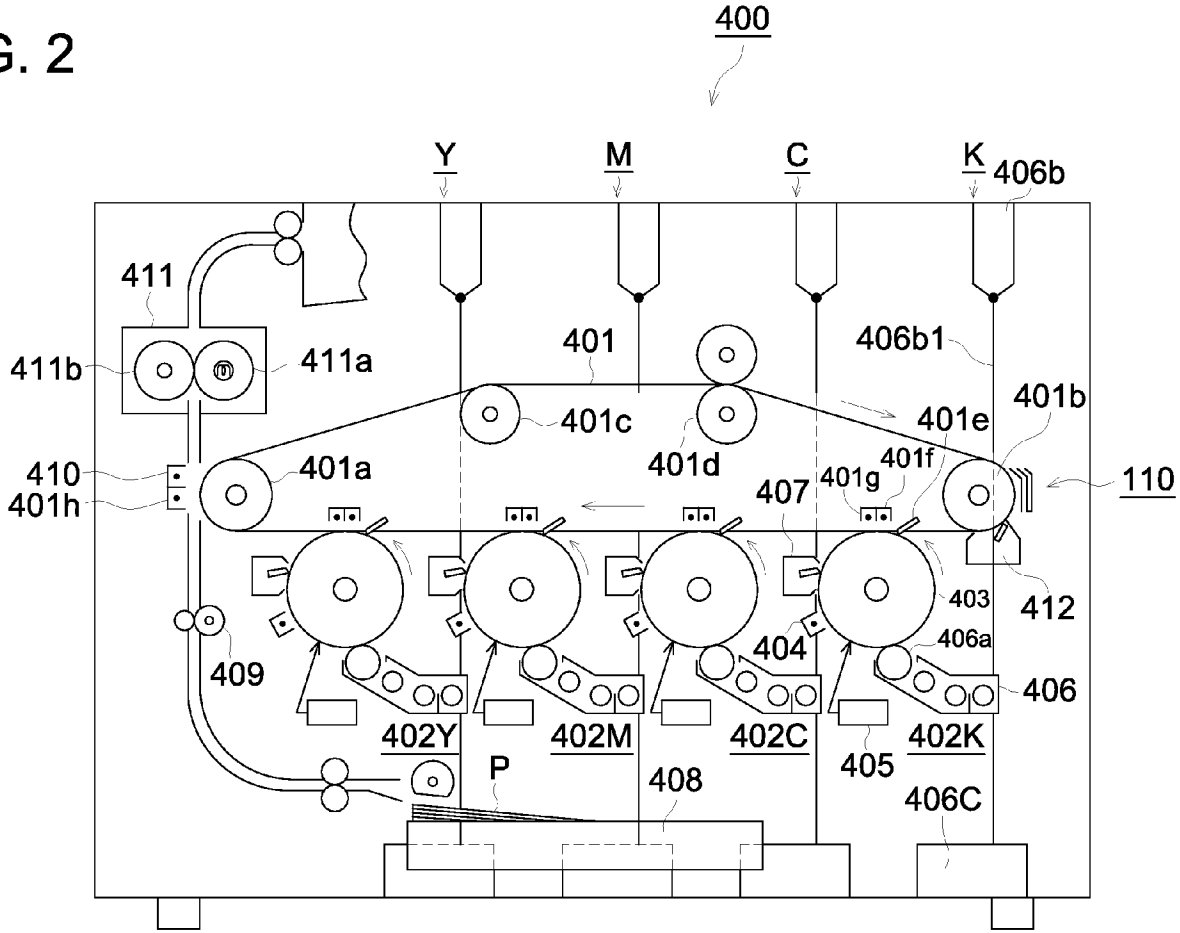
FIG. 2 is a principal part cross sectional view about an embodiment of an image forming apparatus comprising an electric charge eliminating device 110 relating to the present invention and an intermediate transfer belt 401 as a recording medium carrier being an electric charge elimination object.

FIG. 2 is a principal part cross sectional view about an embodiment of an image forming apparatus which comprises the electric charge eliminating device 110 relating to the present invention and an intermediate transfer belt 401 as an image carrying member of an electric charge elimination object. With regard to this figure, the following explanation will be made about an embodiment of a tandem type color image forming apparatus 400 as an image forming apparatus.

In the color image forming apparatus 400, a plurality of image forming members are arranged in parallel, and their structures and functions are as described below. Around the periphery of the intermediate transfer belt 401 which is an intermediate transfer member, provided are four sets of process units 402Y, 402M, 402C, and 402K for forming four color toner images of yellow (Y), magenta (M), cyan (C), and black (K). Monochromatic toner images of Y, M, C, and K formed by the respective process units 402Y, 402M, 402C, and 402K are superimposed on the intermediate transfer belt 401, and the superimposed toner images are collectively transferred as a color image onto a recording sheet P. The color image is fixed on the recording sheet P, and is discharged outside the apparatus.

Numeral 403 represents a photoreceptor drum which is an image forming member, and is arranged for each color of Y, M, and C and K. On the periphery of the photoreceptor drum 403, arranged are a scorotron charging unit 404 which is an electrically charging section, an exposure optical system 405 which is an image write-in section, a developing unit 406, and a cleaning device 407 which is a cleaning sections of the photoreceptor drum 403. These components are provided for the respective photoreceptor drums 403 provided for the colors of Y, M, and C and K.

In the respective photoreceptor drums 403 which are image forming members for colors of Y, M, and C and K, an organic photoreceptor layer (OPC) provided with an overcoat layer (protective layer) on its surface is formed on an outer periphery of a cylindrical metallic base member formed with, for example, aluminium. The intermediate transfer belt 401 being an image carrier is brought in contact with the photoreceptor drum 403 so that when the intermediate transfer belt 401 is shifted, the photoreceptor drum 403 is driven and rotated by receiving a driving force from the intermediate transfer belt 401, whereby the respective photoreceptor drums 403 for four colors are rotated in the direction indicated with an arrowed mark on the grounded condition.

The scorotron charging unit 404, which is an electrically charging section for each color, performs an electrically charging action (in this embodiment, minus electrification) with corona discharge having the same polarity (in this embodiment, a minus polarity) with toner by a control grid and a corona discharge electrode which are maintained at a predetermined electric potential respectively. With this electrically charging action, the photoreceptor drum 403 is provided with a uniform electric potential. The scorotron charging unit 404 may employs a sawtooth-like electrode and a needlelike electrode as the corona discharge electrode.

The exposure optical system 405, which is an image write-in section for each color of Y, M, and C and K, is arranged around the photoreceptor drum 403 such that its exposure position on the photoreceptor drum 403 for each color is located at the downstream side of the scorotron charging unit 404 in terms of the rotation direction of the photoreceptor drum 403. The exposure optical system 405 conducts image exposure for the photoconductive layer of the photoreceptor drum 403 in accordance with color image data of each color of Y, M, C, and K which have been read by an image reading apparatus in a separate body and are memorized in a memory, whereby an electrostatic latent image is formed on the photoreceptor drum 403 for each color.

The developing unit 406, which is a developing section of each color of Y, M, and C and K, maintains a predetermined gap to the peripheral surface of the photoreceptor drum 403 as explained with reference FIG. 1, and the developing unit 406 has a developing sleeve 406*a* rotated in the same direction with that of the photoreceptor drum 403. The developing sleeve 406*a* is structured with, for example, a cylinder made of nonmagnetic stainless steel or aluminium with a thickness of 0.5 to 1 mm and an outer diameter of 15 to and 25 mm. The developing unit 406 accommodates a two component type developing agent of one of yellow (Y), magenta (M), cyan (C), and black (K) corresponding to one of developing colors of Y, M, C and K. In the developing unit 406, a gap between the developing sleeve 406*a* and the photoreceptor drum 403 is maintained at a predetermined value of for example, 100 μm to 500 μm with a spacing roller (not shown), and the developing sleeve 406*a* is applied with a developing bias which is a direct current voltage or a direct current voltage superimposed with an alternating current voltage. With this, the developing agent is carried on the periphery of the developing sleeve 406*a*, and is made in a stand-up brush condition, whereby the developing unit 406 conducts a contact type reversal development so as to form a toner image on the photoreceptor drum 403.

Further, the developing unit 406 has a hopper 406*b* which supplies a two component type developer, and a recovery container 406*c* for collecting the two component type developer discharged from the developing unit 406, and the hopper and the recovery container are provided to the developing unit of each color of Y, M, and C and K. As explained with reference to FIG. 1, the concentration of toner of the two component type developer in the developing unit becomes low as the development progresses. Accordingly, the concentration of toner is detected by a toner concentration detection sensor 101*c* (refer to FIG. 1) in the developing unit, and toner is supplied based on the detected information by the hopper through a supply pipe 406*b*1.

The ratio of toner and carrier which constitute the two component type developer to be supplied is mixed such that it may become the ratio of toner and carrier in the developing unit on a normal state, and usually, toner is made large in content as compared with carrier.

The supplied two component type developer is mixed and agitated with the used two component type developer in the developing unit. The amount of the two component type developer is detected by an interface level detecting section (not shown) provided in the developing unit, and when the surplus condition of the two component type developer is detected, the excess portion of the two component type developer is discharged to the outside of the developing unit by a discharging section such as a screw pump. In this way, the repetition of the supply and discharge makes it possible to stabilize the performance of the two component type developer in the developing unit.

On the photoreceptor drum 403 which is uniformly electrically charged by the scorotron charging unit 404, image exposure is performed by the exposure optical system 405 so that an electrostatic latent image is formed, and the electrostatic latent image is developed by the developing unit 406, whereby a toner image is formed. This toner image is transferred onto the intermediate transfer belt 401 at a transfer position. After the toner image has been transferred, the remaining toner on the photoreceptor drum 403 is cleaned by the cleaning apparatus 407 which conducts collecting the remaining toner electro-statically.

The respective process units 402Y, 402M, 402C, and 402K are arranged in parallel and opposite to the intermediate transfer belt 401, and this intermediate transfer belt 401 is an endless belt having a volume resistivity of $10^{12}$ Ωcm to $10^{15}$ Ωcm. The intermediate transfer belt 401 is produced such that for example, a conductive material is dispersed into engineering plastics, such as modified polyimide, a heat-curing polyimide, an ethylene tetrafluoroethylene copolymer, polyvinylidene fluoride, a nylon alloy and the like. The intermediate transfer belt 401 is a seamless belt with a two layer structure in which a fluorine coating is preferably formed with a thickness of 5 to 50 μm as a toner filming prevention layer on the outside of the semi conductive film base member with a thickness of 0.1 to 1.0 mm. As the base member of the intermediate transfer belt 401, in addition to the above, employed may be a semi conductive rubber belt with a thickness of 0.5 mm to 2.0 mm in which conductive materials are dispersed in a silicone rubber or a urethane rubber. The intermediate transfer belt 401 is stretched so as to circumscribe around a driving roller 401*a*, a follower roller 401*b*, a tension roller 401*c*, and a backup roller 401*d*. At the time of forming an image, the driving roller 401*a* is rotated by a driving motor (not shown) so that the intermediate transfer belt 401 is rotated in a direction indicated with a arrows mark while being pressed onto the photoreceptor drum 403 by a pressing elastic plate 401*e* arranged at the upstream side of the transfer position of each color. At this time, the photoreceptor drums 403 are driven and rotated while following the shift of the intermediate transfer belt 401 by receiving a driving force of the intermediate transfer belt 401.

Primary transfer devices 401*f*, which are a transfer section for each color, include corona discharge devices, are arranged opposite to the respective photoreceptor drums 403 for each color across the intermediate transfer belt 401, and form the transfer area for each color between the intermediate transfer belt 401 and the respective photoreceptor drums 403 for colors of Y, M, C, and K. The primary transfer devices 401*f* are applied with a direct current voltage with a opposite polarity to that of toner (in this embodiment, a plus polarity) so as to form a transfer electric field in the respective transfer areas, whereby a toner image on the photoreceptor drum 403 for each color is transferred on the intermediate transfer belt 401.

Electric charge eliminating devices 401*g*, which are an electric charge eliminating section for each color, are constituted by a corona discharge device, and conduct electric charge elimination for the intermediate transfer belt 401 electrically charged by the primary transfer devices 401*f*.

The pressing elastic plates 401*e* to press the transfer belt are made of a rubber blade, such as urethane. The pressing elastic plate 401*e* are arranged at the upstream side of the transfer position of each color. Therefore, at the time of forming an image, the pressing elastic plates 401*e* press the intermediate transfer belt 401 onto the respective photoreceptor drums 403 so that the photoreceptor drums 403 are made to follow the shift of the intermediate transfer belt 401 and rotate.

When an image recording is started, a photoreceptor driving motor (not shown) is started, toner images of colors of Y, M, C and K are formed on the photoreceptor drums 403, and then the toner images are sequentially transferred onto the intermediate transfer belt 401, whereby a superimposed color toner image of Y, M, C and K is formed.

In synchronization with the color toner image formation superimposed on the intermediate transfer belt 401, a recording sheet P is conveyed from a paper sheet cassette 408 being a transfer material storage section, through a timing roller 409 as a transfer material feeding section to a transfer area (with no reference symbol) of a secondary transfer device 401*h* being a second transfer section. Then, the secondary transfer device 401*h* is applied with a direct current voltage with a reverse polarity (in this embodiment, a plus polarity) to that of toner, whereby the superimposed color toner image on the intermediate transfer belt 401 is collectively transferred onto the recording sheet P.

After the toner images have been transferred, residual toners remained on the peripheral surfaces of the photoreceptor drums 403 for colors of Y, M, and C, and K are cleaned by the cleaning devices 407 which are a cleaning section for the image forming member of each color.

The recording sheet P on which a color toner image has been transferred is subjected to electric charge elimination by an electric charge eliminating electrode 410 which also acts a separating section, and then is conveyed to the fixing device 411. In the fixing device 411, the recording sheet P is applied with heat and pressure between a fixing roller 411*a* and a pressing roller 411*b* so that the toner image is fixed onto the recording sheet P, thereafter, the recording sheet P is discharged onto a tray at the outside of the apparatus.

The electric charge eliminating device 110 relating to the present invention is arranged at a position opposite to a follower roller 401*b* of a plurality of rollers around which the intermediate transfer belt 401 is wound and is adapted to eliminate a residual potential on the intermediate transfer belt 401.

After a color toner image has been transferred, the residual toner after the transferring which remains on the intermediate transfer belt 401 is cleaned by a cleaning apparatus 412 being a cleaning section which is provided to be opposite to the follower roller 401*b* across the intermediate transfer belt 401.

Figure 3:
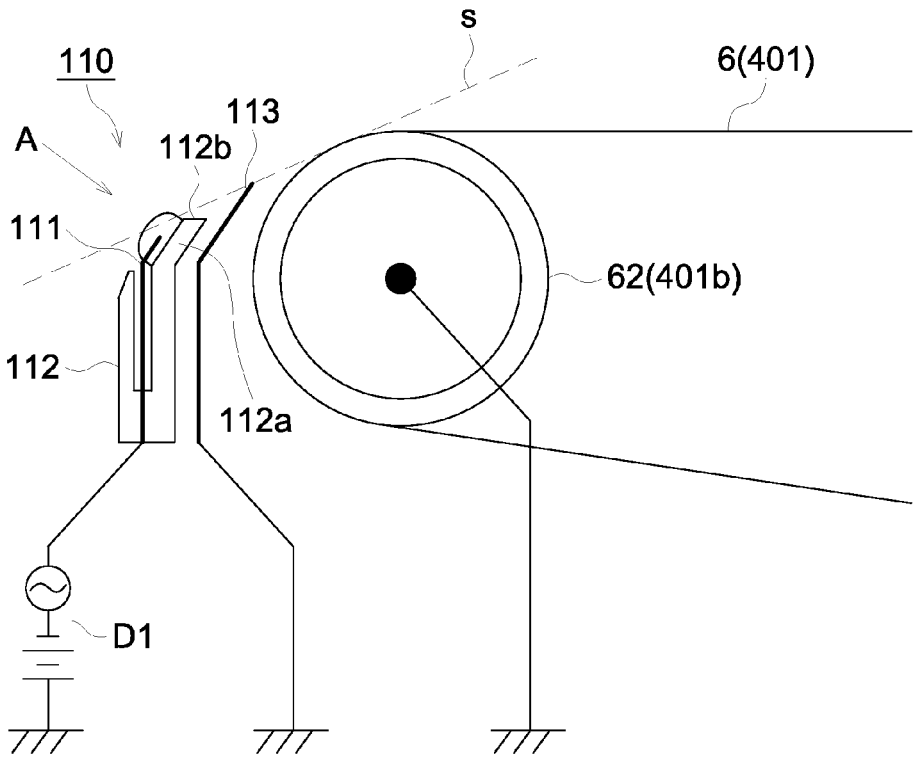
FIG. 3 is an outline structural view for explaining a structure of the first embodiment of the electric charge eliminating device 110 relating to the present invention.
Figure 4A:
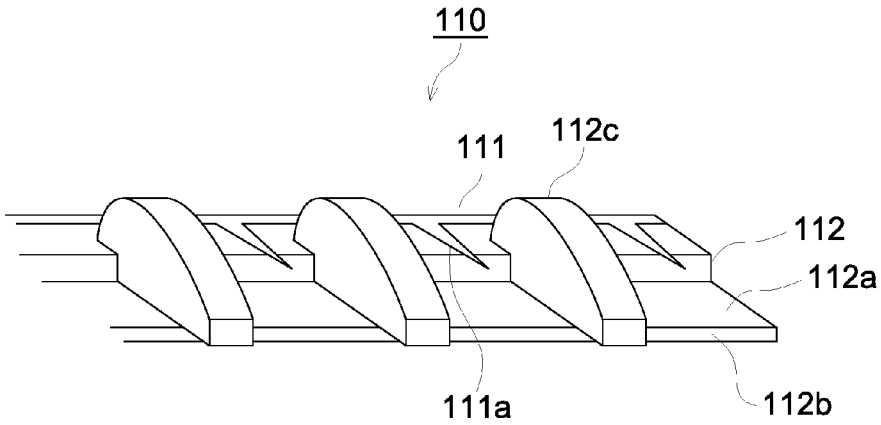
FIG. 4*a* is a perspective view of FIG. 3
Figure 4B:
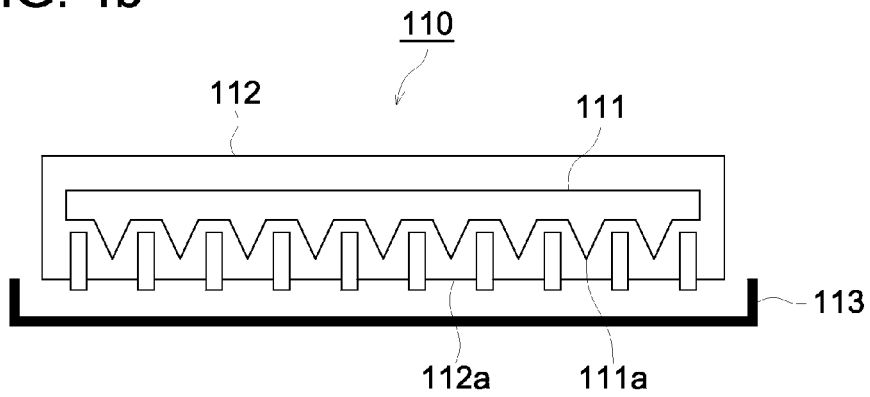
FIG. 4*b* is a drawing viewed from an arrowed mark A.

FIG. 3 is an outline structural view for explaining the structure of the first embodiment of the electric charge eliminating device 110 relating to the present invention, FIG. 4*a* is a perspective view of FIG. 3, and FIG. 4*b* is a drawing viewed from an arrowed mark A in FIG. 3. The electric charge eliminating device 110 is adapted to eliminate the residual potential on the transfer belt 6 wound around the support roller 62 in the abovementioned monochrome image forming apparatus 100 (refer to FIG. 1) or on the intermediate transfer belt 401 wound around the follower roller 401*b* in the color image forming apparatus 400 (refer to FIG. 2).

The electric charge eliminating device 110 of the first embodiment comprises a needlelike electrode 111 connected to a discharging power source D 1 in which an AC voltage is superimposed on a DC voltage, an insulating holder 112 for holding the needlelike electrode 111, and a conductive shielding plate 113 as a shielding member arranged between the transfer belt 6 or the intermediate transfer belt 401 and the needlelike electrode 111. In the first embodiment, the conductive shielding plate 113 is grounded.

As shown in FIG. 4*b*, the needlelike electrode 111 of the present invention is formed by a plate-like conductive member which includes a plurality of interlinked sawtooth-like (or needlelike) protrusions 111*a*, and the tip ends of the plurality of protruding sections 111*a* woke as a plurality of discontinuous discharge points. The needlelike electrode 111 is connected to the discharging power source D 1 as a power source for discharge. In the vicinity of the protruding sections 111*a* of the needlelike electrode 111 on the insulating holder 112 holding the needlelike electrode 111, formed are a cover section 112*a*, a tip section 112*b*, and a plurality of partition wall sections 112*c*. The cover section 112*a* is located between the protruding sections 111*a* of the needlelike electrode 111 and the conductive shielding plate 113 so that cover section 112*a* prevents an excessive discharge current from the needlelike electrode 111 to the conductive shielding plate 113. The tip portions of the protruding sections 111*a* of the needlelike electrode 111 are arranged at the positions where the tip portions of the protruding sections 111*a* do not protrude from the tip 112*b* section of the cover section 112*a*. The plurality of partition wall sections 112*c* are formed at positions where two of the plurality of partition wall sections 112*c* sandwich one of the protruding sections 111*a* of the needlelike electrode 111, so that the plurality of partition wall sections 112*c* prevent an operator's hand from contacting the protruding sections 111*a* of the needlelike electrode 111 to which high voltage is applied.

The conductive shielding plate 113 as a shielding member which has conductivity and relates to the present invention is arranged at a location where the conductive shielding plate 113 stands opposite the transfer belt 6 wound around the support roller 62 or the intermediate transfer belt 401 wound around the follower roller 401*b*.

The support roller 62 and the follower roller 401*b* have a conductive cored metal bar respectively, an elastic layer is formed on the cored metal bar, and a resin coat layer having conductivity is formed as an outermost layer section. In this embodiment, the support roller 62 and the follower roller 401*b* are structured with tree layers of the cored metal bar, the elastic layer, and the resin coat layer respectively. However, they may be structured with two layers without the elastic layer.

A reference symbol "s" shown in FIG. 3 represents a tangent line which passes along the tip of the conductive shielding plate 113 and comes in contact with the surface of the transfer belt 6 wound around the support roller 62 or the surface of the intermediate transfer belt 401 wound around the follower roller 401*b*.

When the discharge from the protruding sections 111*a* of the needlelike electrode 111 is started with the voltage applied from the power source D1, a part of excessive discharge current generated from the protruding sections 111*a* flows into the ground via the conductive shielding plate 113, whereby discharge unevenness can be suppressed.

According to the first embodiment of the electric charge eliminating device 110 relating to the present invention, the excessive discharge current generated from the protruding sections 111*a* of the needlelike electrode 111 can be made to flow through the conductive shielding plate 113 with the simple structure to ground the conductive shielding plate 113, whereby the discharge unevenness preventive measures can be achieved at low cost.

Figure 5:
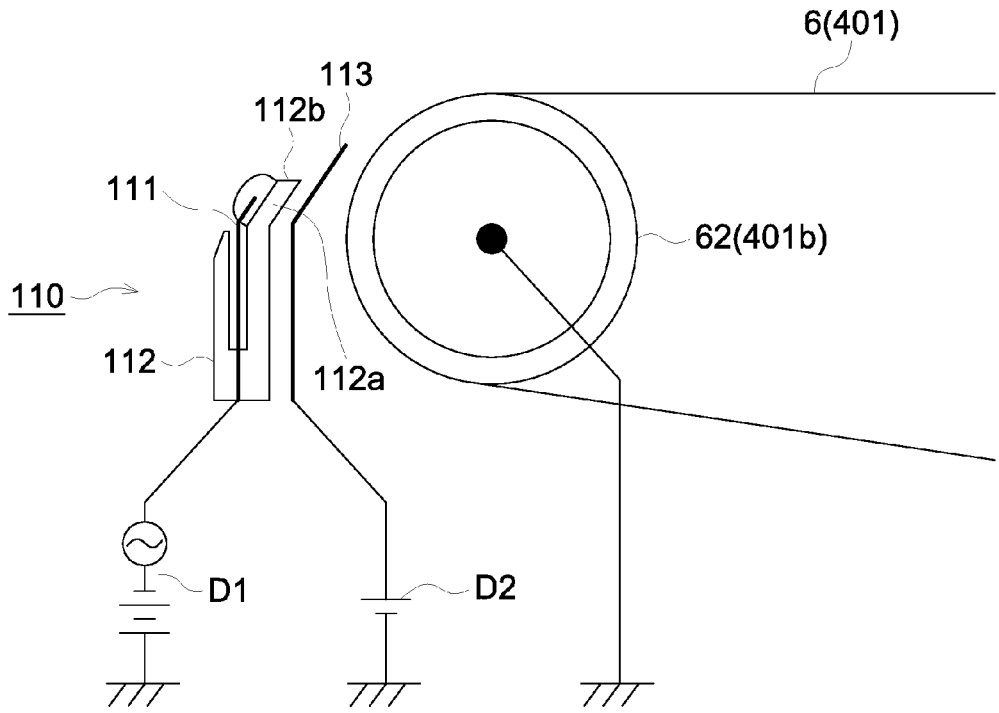
FIG. 5 is an outline structural view for explaining a structure of the second embodiment of the electric charge eliminating device 110 relating to the present invention.

FIG. 5 is an outline structural view for explaining the structure of the second embodiment of the electric charge eliminating device 110 relating to the present invention. The second embodiment is similar to the first embodiment, and the same reference symbol is given to a member having the same function. Therefore, an explanation for such a member is omitted, and only a different structure is explained. The point that the second embodiment differs from the first embodiment is the difference in the member connected to the conductive shielding plate 113. That is, in the first embodiment, the member connected to the conductive shielding plate 113 is only the grounding. However, in the second embodiment, a bias power source D2 as a power source for shielding member is connected to the conductive shielding plate 113. In this embodiment, an electric potential of −300 V is provided to the power source D2 so that a part of minus current due to the discharge from the needlelike electrode 111 is made to flow to the ground through the conductive shielding plate 113, whereby an excessive current can be prevented from flowing into the transfer belt 6 or the intermediate transfer belt 401.

According to the second embodiment of the electric charge eliminating device 110 relating to the present invention, since it is possible to control the polarity of an electric potential and a value of a voltage to be provided, discharge unevenness caused by the needlelike electrode 111 can be adjusted finely in accordance with conditions, such as an environmental condition and the working hours of an apparatus.

Hereafter, the third through sixth embodiments of the electric charge eliminating device 110 relating to the present invention will be explained. However, the third through sixth embodiments are similar to the second embodiment, and the same reference symbol is given to a member having the same function. Therefore, an explanation for such a member is omitted, and only a different structure is explained. The point that the third through sixth embodiments differ from the second embodiment is the difference in the member connected to the conductive shielding plate 113. That is, in the second embodiment, the member connected to the conductive shielding plate 113 is the bias power source D2. However, in the third through sixth embodiments, respective different electric components are connected as a member to control a current flowing into the conductive shielding plate 113. Namely, in the third embodiment, a resister T is connected, in the fourth embodiment, a valuable resister KT is connected, in the fifth embodiment, a varistor VR is connected, and in the sixth embodiment, a zener diode ZD is connected.

Figure 6:
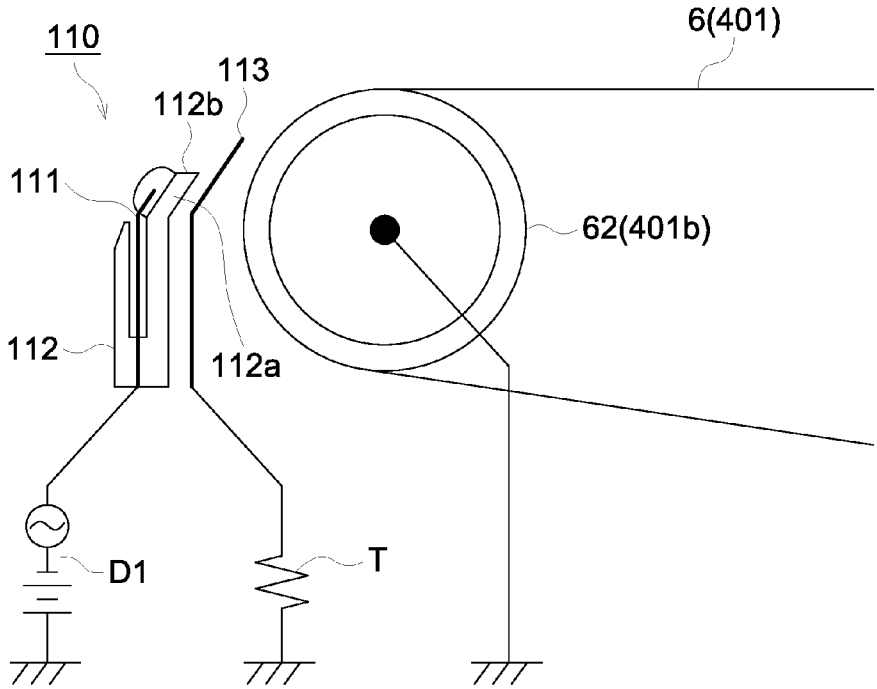
FIG. 6 is an outline structural view for explaining a structure of the third embodiment of the electric charge eliminating device 110 relating to the present invention.

FIG. 6 is an outline structural view for explaining the structure of the third embodiment of the electric charge eliminating device 110 relating to the present invention. In the third embodiment, a resister T is used as an electric component connected to the conductive shielding plate 113.

According to the third embodiment of the electric charge eliminating device 110 relating to the present invention, discharge unevenness of the needlelike electrode 111 can be adjusted with the simple structure to connect the resister T to the conductive shielding plate 113, whereby the discharge unevenness preventive measures can be achieved at low cost with space saving.

Figure 7:
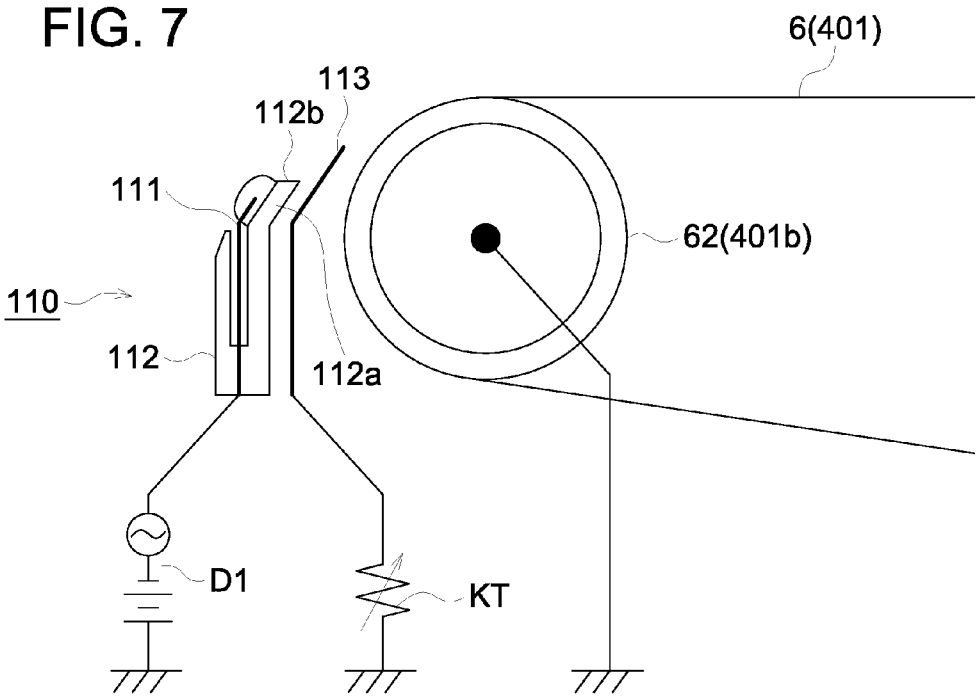
FIG. 7 is an outline structural view for explaining a structure of the fourth embodiment of the electric charge eliminating device 110 relating to the present invention.

FIG. 7 is an outline structural view for explaining the structure of the fourth embodiment of the electric charge eliminating device 110 relating to the present invention. In the fourth embodiment, a variable resister KT is used as an electric component connected to the conductive shielding plate 113.

According to the fourth embodiment of the electric charge eliminating device 110 relating to the present invention, the structure to connect the variable resister KT to the conductive shielding plate 113 makes it possible to control the value of the provided voltage, whereby discharge unevenness can be adjusted in accordance with conditions, such as an environmental condition and the working hours of an apparatus.

Figure 8:
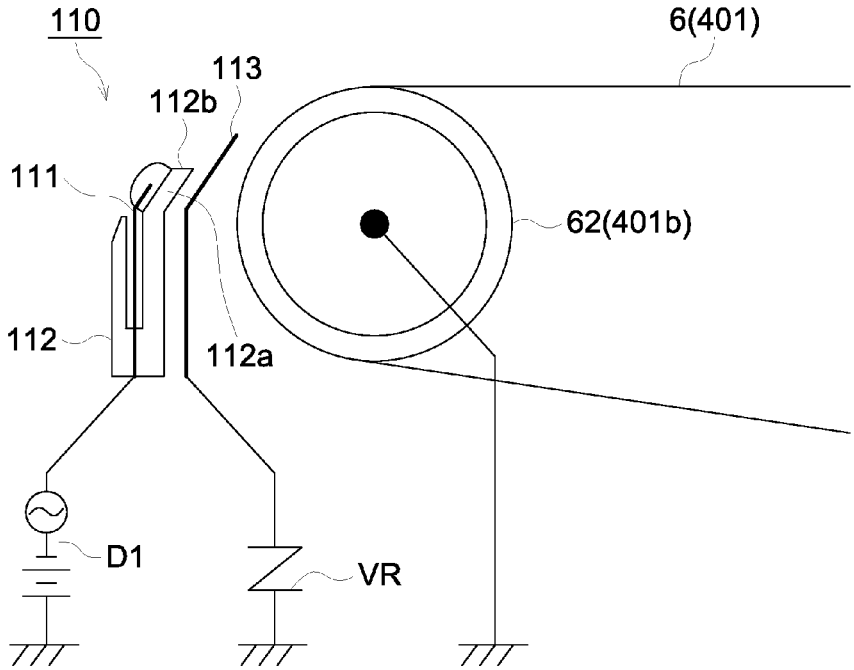
FIG. 8 is an outline structural view for explaining a structure of the fifth embodiment of the electric charge eliminating device 110 relating to the present invention.

FIG. 8 is an outline structural view for explaining the structure of the fifth embodiment of the electric charge eliminating device 110 relating to the present invention. In the fifth embodiment, a varistor VR is used as an electric component connected to the conductive shielding plate 113.

According to the fifth embodiment of the electric charge eliminating device 110 relating to the present invention, the structure to connect the varistor VR to the conductive shielding plate 113 makes it easy to maintain the value of the voltage of the conductive shielding plate 113, whereby the discharge unevenness preventive measures can be achieved precisely.

Figure 9:
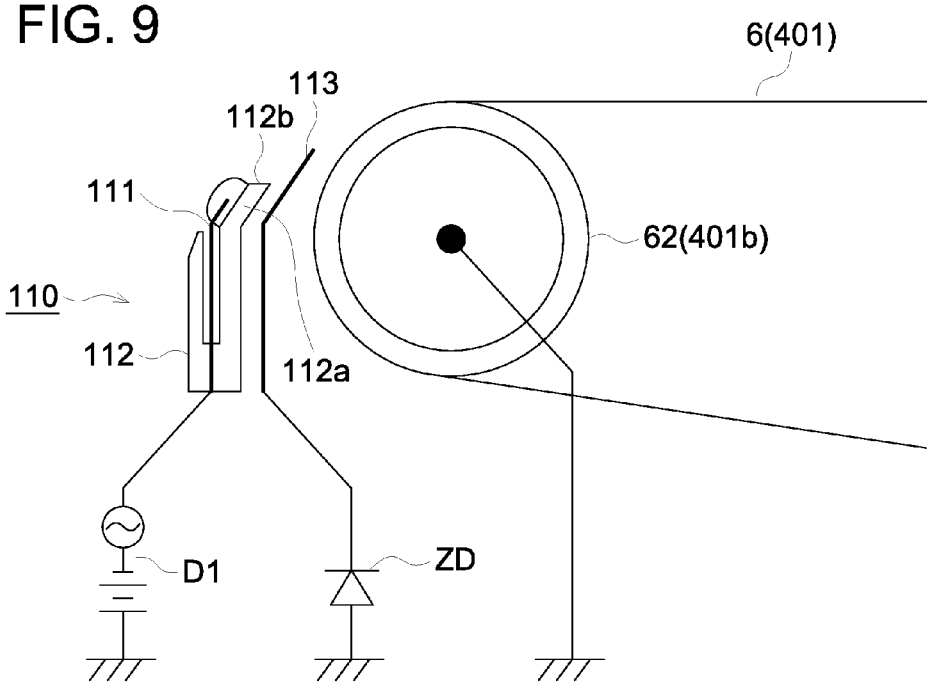
FIG. 9 is an outline structural view for explaining a structure of the sixth embodiment of the electric charge eliminating device 110 relating to the present invention.

FIG. 9 is an outline structural view for explaining the structure of the sixth embodiment of the electric charge eliminating device 110 relating to the present invention. In the sixth embodiment, a zener diode ZD is used as an electric component connected to the conductive shielding plate 113. The change of the connection direction of the zener diode ZD makes it possible to change the polarity of an electric potential provided to the conductive shielding plate 113.

According to the sixth embodiment of the electric charge eliminating device 110 relating to the present invention, the structure to connect the zener diode Zn to the conductive shielding plate 113 makes it possible to provide an electric potential different in polarity in accordance with the polarity of the residual electric charge on the transfer belt 6 or the intermediate transfer belt 401. Namely, in accordance with the polarity of the residual electric charge on the transfer belt 6 or the intermediate transfer belt 401, an electric potential with the corresponding polarity can be made to flow through the conductive shielding plate 113, whereby, even if the polarity of a residual electric charge is any one of plus and minus, the residual electric charge can be eliminated precisely.

Figure 10:
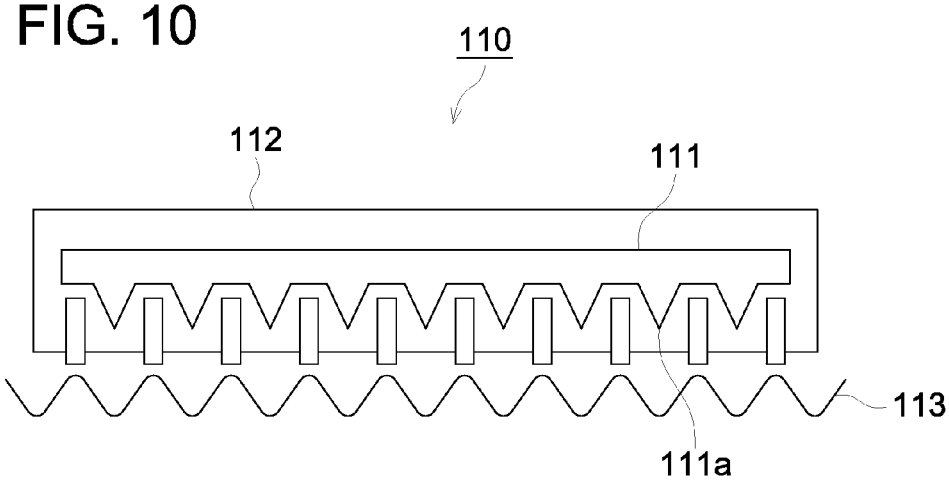
FIG. 10 is an outline structural view for explaining a structure of the seventh embodiment of the electric charge eliminating device 110 relating to the present invention.

FIG. 10 is an outline structural view for explaining the structure of the seventh embodiment of the electric charge eliminating device 110 relating to the present invention. The seventh embodiment is similar to the first through sixth embodiments, and the same reference symbol is given to a member having the same function. Therefore, an explanation for such a member is omitted, and only a different structure is explained. The point that the seventh embodiment differs from the first through sixth embodiments is in the configuration of the conductive shielding plate 113. That is, in the first through sixth embodiments, the configuration of the conductive shielding plate 113 is a flat plate. However, in the seventh embodiment, it is formed by a wavelike plate member with a continuous concavo-convex curved surface.

In FIG. 10, the pitch of the convex portions or the concave portions of the wavelike plate member forming the conductive shielding plate 113 conforms to that of the protruding sections 111*a* of the needlelike electrode 111, and the concave portions of the wavelike plate member are arranged opposite to the protruding sections 111*a*.

As explained in FIG. 3, the tips of the protruding sections 111*a* of the needlelike electrode 111 are located in the inside (the lower side in FIG. 3) in relation to the tangent line "s" which passes along the tip of the conductive shielding plate 113 and comes in contact with the surface of the transfer belt 6 or the surface of the intermediate transfer belt 401. Therefore, the position of the convex portions of the wavelike plate member of the conductive shielding plate 113 becomes close to the tip of the protruding sections 111*a* of the needlelike electrode 111 and the position of the concave portions becomes far from the tip of the protruding sections 111*a*. Accordingly, among current discharged from the tips of the protruding sections 111*a*, in the vicinity of the protruding sections 111*a* of the needlelike electrode 111, a current component is intercepted by the concave portions located at a more distant position on the wavelike plate member and tends to flow easily along the conductive shielding plate 113, so that a current component arriving to the transfer belt 6 or the intermediated transfer belt 401 becomes small. On the other hand, in the vicinity of the valley portion between the protruding sections 111*a*, a current component passes over the convex portions located at a more close position on the wavelike plate member, so that a current component arriving to the transfer belt 6 or the intermediated transfer belt 401 becomes large. In other words, among the current discharged from the tips of the protruding sections 111*a*, in the vicinity of the protruding sections 111*a* of the needlelike electrode 111, many currents flow along the conductive shielding plate 113, and in the vicinity of the valley portion between the protruding sections 111*a*, many currents flow onto the transfer belt 6 or the intermediated transfer belt 401. With this, discharge unevenness due to the protruding sections 111*a* of the needlelike electrode 111 can be suppressed. Further, the change of the setting of the level difference in the wave of the wavelike plate makes it possible to adjust the degree of the discharge unevenness.

According to the seventh embodiment of the electric charge eliminating device 110 relating to the present invention, with the employment of the conductive shielding plate 113 formed by a wavelike plate member, discharge unevenness can be suppressed with a simple structure.

Figure 11:
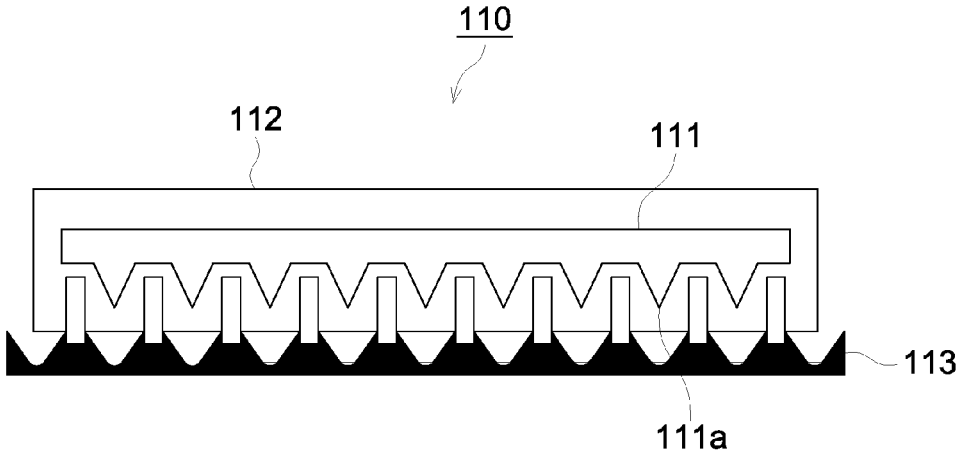
FIG. 11 is an outline structural view for explaining a structure of the eighth embodiment of the electric charge eliminating device 110 relating to the present invention.

FIG. 11 is an outline structural view for explaining the structure of the eighth embodiment of the electric charge eliminating device 110 relating to the present invention. The eighth embodiment is similar to the seventh embodiment, and the same reference symbol is given to a member having the same function. Therefore, an explanation for such a member is omitted, and only a different structure is explained. The point that the seventh embodiment differs from the first through sixth embodiments is in the configuration of the conductive shielding plate 113. That is, in the seventh embodiment, the configuration of the conductive shielding plate 113 is a wavelike plate member. However, in the eighth embodiment, a material with a high resistance is coated or pasted in a wavelike form (a black solid portion in FIG. 11). Further, the pitch of the convex portions or the concave portions of the wavelike curve is adapted to conform to that of the protruding sections 111*a* of the needlelike electrode 111 and the concave portions of the wavelike curve are formed so as to be opposite to the protruding sections 111*a* of the needlelike electrode 111. Therefore, as with the seventh embodiment, among the current discharged from the tips of the protruding sections 111*a*, in the vicinity of the protruding sections 111*a* of the needlelike electrode 111, many currents flow along the conductive shielding plate 113, and in the vicinity of the valley portion between the protruding sections 111*a*, many currents flow onto the transfer belt 6 or the intermediated transfer belt 401. With this, discharge unevenness due to the protruding sections 111*a* of the needlelike electrode 111 can be suppressed.

According to the eighth embodiment of the electric charge eliminating device 110 relating to the present invention, with the employment of the conductive shielding plate 113 formed by a material coated or pasted in a wavelike form, discharge unevenness can be suppressed with a simple structure.

Next, the following explanation will be made about the positional relationship among the protruding sections 111*a* of the needlelike electrode 111, the tip 112*b* of the insulating holder 112, and the tip of the conductive shielding plate 113 in the electric charge eliminating device 110 relating to the present invention with reference to FIG. 12

Figure 12:
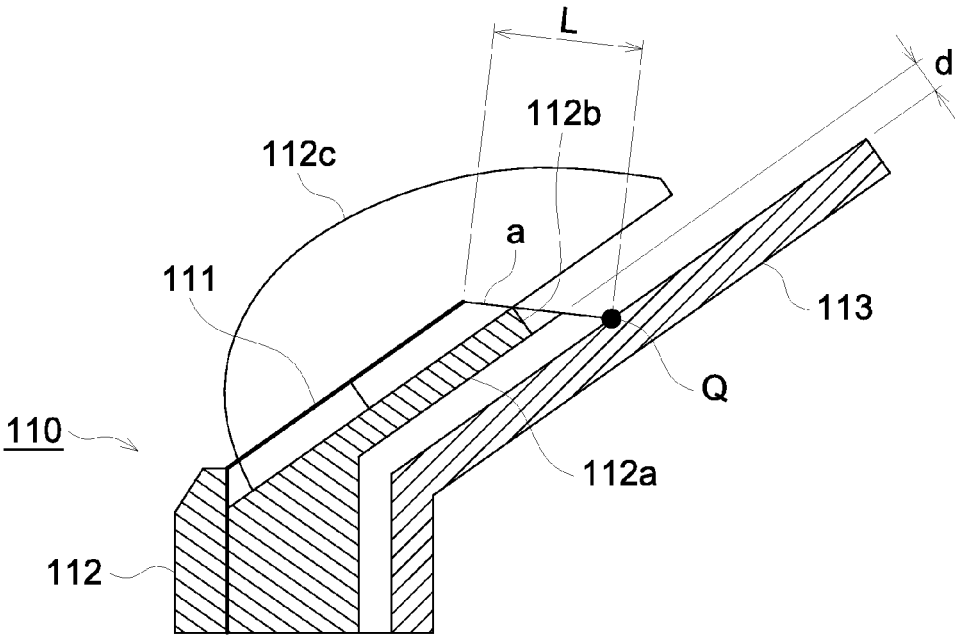
FIG. 12 is a fragmentary sectional view for explaining the positional relationship among the needlelike electrode 111, the insulating holder 112, and the conductive shielding plate 113 in the electric charge eliminating device 110 relating to the present invention.

FIG. 12 is a partial cross sectional view for explaining the positional relationship of the needlelike electrode 111, the insulating holder 112, and the conductive shielding plate 113 in the electric charge eliminating device 110 relating to the present invention. Since the positional relationship of the needlelike electrode 111, the insulating holder 112 and the conductive shielding plate 113 for the transfer belt 6 or the intermediate transfer belt 401 has been already explained in FIG. 3, the explanation for it is omitted here.

A reference symbol "a" represents a straight line which connects the tip of the needlelike electrode 111 and the tip 112*b* of the insulating holder 112 with the shortest distance, and a reference symbol "Q" represents an arbitrary point that the straight line "a" intersects the surface of the conductive shielding plate 113. Further, a reference symbol "L" represents a shortest air space distance between the tip of the needlelike electrode 111 and the point Q where the straight line "a" intersects with the conductive shielding plate 113. A reference symbol "d" represents a holder-to-shielding plate gap between the tip 112*b* of the cover section 112*a* of the insulating holder 112 and the surface of the conductive shielding plate 113. The position and length of each of the needlelike electrode 111, the insulating holder 112 and the conductive shielding plate 113 are set up such that the extension line of the straight line "a" intersects necessarily on the conductive shielding plate 113 (at the crossing point Q).

In FIG. 12, the tip position of the needlelike electrode 111 is arranged at a position where the tip does not protrude from the tip position of the cover section 112*a* of the insulating holder 112. The conductive shielding plate 113 is adapted to have a region of an unexposed portion where the conductive shielding plate 113 is covered with the cover section 112*a* of the insulating holder 112 and a region of an exposed portion where the conductive shielding plate 113 is not covered with the cover section 112*a*. The electric field is formed by the needlelike electrode 111 toward the region of the exposed portion on the conductive shielding plate 113 which locates from the neighborhood of the point "Q" where the straight line intersects with the conductive shielding plate 113 to the tip of the conductive shielding plate 11.

The present inventors have grasped through an experiment that the proper setting of the shortest air space distance "L" and the holder-to-shielding plate gap "d" makes it possible to prevent discharge unevenness by a needlelike electrode in the electric charge eliminating device which employs an intermediate transfer belt or transfer belt each made of resin. Concretely, when the value of the shortest air space distance "L" is set to 1.5 to 5.5 mm and the value of the holder-to-shielding plate gap "d" is set to 0.3 to 2.0 mm, it was confirmed that an influence due to discharge unevenness can be made to be not caused on a transfer belt 6, an intermediate transfer belt 401 or a roller around which a belt is wound. Herein, the influence due to discharge unevenness the occurrence of streak like flows caused by breakage of polymer chain of a resin material for a belt and peel-off of a resin coat layer for a roller around which a belt is wound.

The abovementioned object of the present invention can be also attained by an electric charge eliminating device having the following preferable structures.

1. An electric charge eliminating device for conducting electric charge elimination of an image carrier or a recording medium carrier which is incorporated in an image forming apparatus, comprises:

a needlelike electrode having protruding portions as a plurality of discontinuous discharge points;

an insulating holder for holding the needlelike electrode;

a power source for needlelike electrode and for applying an electric voltage to the needlelike electrode; and a conductive shielding member arranged between the needlelike electrode and the image carrier or the recording medium carrier.

2. The electric charge eliminating device described in the above 1 is characterized in that the shielding member is grounded.

3. The electric charge eliminating device described in the above 1 is characterized in that the shielding member is connected to a power source for a shielding member and for providing an electric potential to the shielding member.

4. The electric charge eliminating device described in the above 1 is characterized in that the shielding member is connected to an electronic component to control current which flows in the shielding member.

5. The electric charge eliminating device described in the above 4 is characterized in that the electronic component is a resistor, a variable resistor, a varistor, or a Zener diode.

6. The electric charge eliminating device described in any one of the above 1 to 5 is characterized in that the shielding member comprises an exposed portion as a region exposed in an electric field formed by the needlelike electrode and an unexposed portion as a region surrounded by the insulating holder; the insulating holder faces the image carrier or any one suspending roller of a plurality of suspending rollers suspending a transfer belt or a recording media conveying belt as the recording media carrier across the transfer belt or the recording media conveying belt, comprises a cover section surrounding the unexposed portion, and holds the needlelike electrode so as to be arranged at such a position that the tip of the needlelike electrode does not protrude from the tip of the cover section; the needlelike electrode, the cover section of the insulating holder and the shielding member face to each other with a gap in the thickness direction; and the position and length of each of the needlelike electrode, the cover section of the insulating holder and the shielding member are set up such that the extension line of a line to connect the tip of the protruding sections of the needlelike electrode and the tip of the cover section comes in contact with a region the exposed portion of the shielding member.

7. The electric charge eliminating device described in the above 6 is characterized in that the shortest air space distance between the tip of the needlelike electrode and the surface of the shielding member is set to be 1.5 to 5.5 mm, and a holder-to-shielding plate gap as a gap between the cover section and the surface of the shielding member is set to be 0.3 to 2.0 mm.

8. The electric charge eliminating device described in any one of the above 1 to 7 is characterized in that the tip of the protruding sections of the needlelike electrode and the cover section of the insulating holder are arranged at one side of a tangent line, wherein the tangent line passes along the tip of the shielding member and comes in contact with the surface of the image carrier or the surface of the recording media carrier, and at the one side of the tangent line, the image carrier or the recording media carrier are arranged.

9. The electric charge eliminating device described in the above 8 is characterized in that the shielding member is made of a wavelike plate member having a continuous concavo-convex curved surface; the pitch of the convex portions or the concave portions of the wavelike curved surface is adapted to conform to that of the protruding sections of the needlelike electrode; and the concave portions of the wavelike curve are formed so as to be opposite to the protruding sections of the needlelike electrode.

10. The electric charge eliminating device described in the above 8 is characterized in that a material with a resistance higher than that of the shielding member is coated or pasted on a region of the shielding member from a position to face the protruding sections of the needlelike electrode to the tip of the shielding member; the end portion of the high resistance material which is opposite to the protruding sections of the needlelike electrode is shaped in a wavelike curved line; the pitch of the convex portions or the concave portions of the wavelike curved line is adapted to conform to that of the protruding sections of the needlelike electrode, and the concave portions of the wavelike curved line are formed so as to be opposite to the protruding sections of the needlelike electrode.

11. The electric charge eliminating device described in any one of the above 1 to 7 is characterized in that the image carrier or the recording media carrier is a transfer belt or a recording media carrying belt which is composed of a single layer resin-made belt, or a resin-coated belt whose surface is coated with a resin material.

12. The electric charge eliminating device described in the above 11 is characterized in that the transfer belt or the recording media carrying belt is suspended by a plurality of suspending rollers; at least one of the plurality of suspending rollers comprises a cored metal bar; and a conductive resin coat layer is formed at the outermost section directly or across an elastic layer on the cored metal bar.

13. An image forming apparatus is characterized by comprising the electric charge eliminating device described in any one of the above 1 to 12, and an image carrier or a recording media carrier.

According to the present invention, it is possible to provide an electric charge eliminating device including a needlelike electrode and an image forming apparatus which eliminates electric charge on an image carrier or a recording media carrier without unevenness and does not cause cleaning failure and image failure without increasing the capacity and size of a power source.

What is claimed is:

1. An electric charge eliminating device for eliminating electric charge on an image carrying member or on a recording medium carrying member which is incorporated in an image forming apparatus, comprising a needlelike electrode having a plurality of protruding sections which form a plurality of discontinuous discharge points;

an insulating holder for holding the needlelike electrode;

a discharging power source for applying an electric voltage to the needlelike electrode; and a conductive shielding member arranged between the needlelike electrode and the image carrying member or the recording medium carrying member.

2. The electric charge eliminating device described in claim 1, wherein the shielding member is grounded.

3. The electric charge eliminating device described in claim 1, wherein the shielding member is connected to a bias power source for providing an electric potential for the shielding member.

4. The electric charge eliminating device described in claim 1, wherein the shielding member is connected to an electronic component to control an electric current that flows in the shielding member.

5. The electric charge eliminating device described in claim 4, wherein the electronic component is a resistor, a variable resistor, a varistor, or a Zener diode.

6. The electric charge eliminating device described in claim 1, wherein a first surface of the shielding member faces the image carrying member or one suspending roller of a plurality of suspending rollers suspending a transfer belt or a recording media conveying belt as the recording media carrying member across the transfer belt or the recording media conveying belt, and a second surface of the shielding member which is a back surface of the first surface comprises an exposed portion exposed in an electric field formed by the needlelike electrode and an unexposed portion which is covered by the insulating holder and is not exposed in the electric field haled by the needlelike electrode.

7. The electric charge eliminating device described in claim 6, wherein the insulating holder comprises a cover section to cover the unexposed portion of the shielding member, and holds the needlelike electrode such that the tips of the plurality of protruding sections of the needlelike electrode do not protrude from the tip of the cover section.

8. The electric charge eliminating device described in claim 7, wherein the cover member of the insulating holder is provided between the needlelike electrode and the shielding member, and wherein the needlelike electrode, the cover member, and the shielding member are arranged such that an extension line of a line connecting a tip of the plurality of protruding sections of the needlelike electrode and a tip of the cover section comes in contact with the exposed portion of the second surface of the shielding member.

9. The electric charge eliminating device described in claim 1, wherein a shortest air space distance between the tip of the plurality of protruding sections of the needlelike electrode and the surface of the shielding member is set to 1.5 to 5.5 mm, and a gap between the cover section and the surface of the shielding member is set to 0.3 to 2.0 mm.

10. The electric charge eliminating device described in claim 1, wherein when a tangent like is drawn so as to pass the tip of the shielding member and to come in contact with the surface of the image carrying member or with the surface of the recording medium carrying member, the tips of the plurality of protruding sections of the needlelike electrode and the cover section of the insulating holder are arranged at the contacted side of the tangent line.

11. The electric charge eliminating device described in claim 1, wherein the tip portion of the shielding member is made of a wavelike plate member having a continuous concavo-convex curved surface; the pitch of the convex portions or the concave portions of the wavelike curved surface is adapted to conform to that of the plurality of protruding sections of the needlelike electrode; and the concave portions of the wavelike curve are formed opposite to one of the plurality of protruding sections of the needlelike electrode respectively.

12. The electric charge eliminating device described in claim 1, wherein on a region of the shielding member from a position the shielding member to face the plurality of protruding sections of the needlelike electrode to the tip of the shielding member, a material with a resistance higher than that of the shielding member is coated or pasted to form a high resistance material layer; the end portion of the high resistance material which faces the plurality of protruding sections of the needlelike electrode is shaped in a wavelike curved surface; the pitch of the convex portions or the concave portions of the wavelike curved surface is adapted to conform to that of the protruding sections of the needlelike electrode, and the concave portions of the wavelike curved surface are formed opposite to one of the plurality of protruding sections of the needlelike electrode respectively.

13. The electric charge eliminating device described in claim 1, wherein the image carrying member or the recording media carrying member is a transfer belt or a recording media carrying belt which is structured with a single layer belt made of a resin material or a resin-coated belt whose surface is coated with a resin material.

14. The electric charge eliminating device described in claim 1, wherein the transfer belt or the recording media carrying belt is wound around a plurality of suspending rollers; at least one of the plurality of suspending rollers comprises a cored metal bar; and a conductive resin coat layer is formed as an uppermost layer on the cored metal bar directly or across an elastic layer.

15. An image forming apparatus, comprising:

an image carrier or a recording media carrier, and an electric charge eliminating device for eliminating electric charge on the image carrying member or on the recording medium carrying member, wherein the electric charge eliminating device comprise:

a needlelike electrode having a plurality of protruding sections which form a plurality of discontinuous discharge points;

an insulating holder for holding the needlelike electrode;

a discharging power source for applying an electric voltage to the needlelike electrode; and a conductive shielding member arranged between the needlelike electrode and the image carrying member or the recording medium carrying member.

16. The image forming apparatus described in claim 15, wherein the shielding member is grounded.

17. The image forming apparatus described in claim 15, wherein the shielding member is connected to a bias power source for providing an electric potential for the shielding member.

18. The image forming apparatus described in claim 15, wherein the shielding member is connected to an electronic component to control an electric current that flows in the shielding member.

19. The image forming apparatus described in claim 18, wherein the electronic component is a resistor, a variable resistor, a varistor, or a Zener diode.

20. The image forming apparatus described in claim 15, wherein a first surface of the shielding member faces the image carrying member or one suspending roller of a plurality of suspending rollers suspending a transfer belt or a recording media conveying belt as the recording media carrying member across the transfer belt or the recording media conveying belt, and a second surface of the shielding member which is a back surface of the first surface comprises an exposed portion exposed in an electric field formed by the needlelike electrode and an unexposed portion which is covered by the insulating holder and is not exposed in the electric field formed by the needlelike electrode.

21. The image forming apparatus described in claim 20, wherein the insulating holder comprises a cover section to cover the unexposed portion of the shielding member, and holds the needlelike electrode such that the tips of the plurality of protruding sections of the needlelike electrode do not protrude from the tip of the cover section.

22. The image forming apparatus described in claim 21, wherein the cover member of the insulating holder is provided between the needlelike electrode and the shielding member, and wherein the needlelike electrode, the cover member, and the shielding member are arranged such that an extension line of a line connecting a tip of the plurality of protruding sections of the needlelike electrode and a tip of the cover section comes in contact with the exposed portion of the second surface of the shielding member.

23. The image forming apparatus described in claim 15, wherein a shortest air space distance between the tip of the plurality of protruding sections of the needlelike electrode and the surface of the shielding member is set to 1.5 to 5.5 mm, and a gap between the cover section and the surface of the shielding member is set to 0.3 to 2.0 mm.

24. The image forming apparatus described in claim 15, wherein when a tangent like is drawn so as to pass the tip of the shielding member and to come in contact with the surface of the image carrying member or with the surface of the recording medium carrying member, the tips of the plurality of protruding sections of the needlelike electrode and the cover section of the insulating holder are arranged at the contacted side of the tangent line.

25. The image forming apparatus described in claim 15, wherein the tip portion of the shielding member is made of a wavelike plate member having a continuous concavo-convex curved surface; the pitch of the convex portions or the concave portions of the wavelike curved surface is adapted to conform to that of the plurality of protruding sections of the needlelike electrode; and the concave portions of the wavelike curve are formed opposite to one of the plurality of protruding sections of the needlelike electrode respectively.

26. The image forming apparatus described in claim 15, wherein on a region of the shielding member from a position the shielding member to face the plurality of protruding sections of the needlelike electrode to the tip of the shielding member, a material with a resistance higher than that of the shielding member is coated or pasted to form a high resistance material layer; the end portion of the high resistance material which faces the plurality of protruding sections of the needlelike electrode is shaped in a wavelike curved surface; the pitch of the convex portions or the concave portions of the wavelike curved surface is adapted to conform to that of the protruding sections of the needlelike electrode, and the concave portions of the wavelike curved surface are formed opposite to one of the plurality of protruding sections of the needlelike electrode respectively.

27. The image forming apparatus described in claim 15, wherein the image carrying member or the recording media carrying member is a transfer belt or a recording media carrying belt which is structured with a single layer belt made of a resin material or a resin-coated belt whose surface is coated with a resin material.

28. The image forming apparatus described in claim 15, wherein the transfer belt or the recording media carrying belt is wound around a plurality of suspending rollers; at least one of the plurality of suspending rollers comprises a cored metal bar; and a conductive resin coat layer is formed as an uppermost layer on the cored metal bar directly or across an elastic layer.

* * * * *